US005484259A

United States Patent [19]

Ahmed et al.

[11] Patent Number: 5,484,259

[45] Date of Patent: Jan. 16, 1996

[54] LOW NOISE CENTRIFUGAL BLOWER

[75] Inventors: Sohail Ahmed, Ballwin; John E. King; Kevin M. May, both of Florissant, all of Mo.

[73] Assignee: Emerson Electric Co., St. Louis, Mo.

[21] Appl. No.: 259,295

[22] Filed: Jun. 13, 1994

[51] Int. Cl.[6] ..... F04D 29/66

[52] U.S. Cl. ..... 415/119; 415/204

[58] Field of Search ..... 415/119, 204, 415/206, 208.1, 211.1, 211.2, 212.1

[56] References Cited

U.S. PATENT DOCUMENTS

| | | | |
|---|---|---|---|
| 353,994 | 12/1886 | Walker et al. | 415/204 |
| 2,951,632 | 9/1960 | Hanson | 415/119 |
| 3,034,702 | 5/1962 | Larsson et al. | 415/204 |
| 3,286,914 | 11/1966 | Baverstock | 415/119 |
| 3,459,365 | 8/1969 | Glucksman et al. . | |
| 3,471,080 | 10/1969 | Gray . | |
| 3,477,635 | 11/1969 | Glucksman et al. . | |
| 3,687,360 | 8/1972 | Prew et al. | 415/204 |
| 3,695,775 | 10/1972 | Zenker . | |
| 4,185,688 | 1/1980 | Wiater et al. . | |
| 4,419,049 | 12/1983 | Gerboth et al. . | |
| 4,494,908 | 1/1985 | Hopfensperger . | |
| 4,712,976 | 12/1987 | Hopfensperger et al. . | |
| 4,735,551 | 4/1988 | Schilling . | |
| 4,799,287 | 1/1989 | Belanger et al. . | |
| 4,951,651 | 8/1990 | Shellenberger . | |
| 5,000,079 | 3/1991 | Mardis . | |
| 5,040,943 | 8/1991 | Dwyer et al. . | |
| 5,120,193 | 6/1992 | Kadle et al. . | |

FOREIGN PATENT DOCUMENTS

| | | | |
|---|---|---|---|
| 9006 | 1/1979 | Japan | 415/119 |
| 350400 | 12/1992 | Japan | 415/204 |
| 591620 | 2/1978 | U.S.S.R. | 415/119 |
| 1657754 | 6/1991 | U.S.S.R. | 415/119 |

*Primary Examiner*—Edward K. Look
*Assistant Examiner*—James A. Larson
*Attorney, Agent, or Firm*—Polster, Lieder, Woodruff & Lucchesi

[57] ABSTRACT

The present invention provides a centrifugal blower wherein the noise at the cutoff has been substantially reduced by providing a vortex in the air flow near the cutoff to redirect the air flow. A fin projects downwardly into the space created by the exhaust outlet to redirect the air flow away from the cutoff and create a vortex to quiet the air flow.

7 Claims, 2 Drawing Sheets

LOW NOISE CENTRIFUGAL BLOWER

BACKGROUND OF THE INVENTION

The present invention relates generally to centrifugal blowers and more particularly to a means for reducing the noise of a centrifugal blower.

Centrifugal blowers and centrifugal fans are well known devices for blowing air and, in some instances, other fluids. A centrifugal blower has a fan wheel and a casing, or housing, with a cutoff as well as an air inlet and an air outlet. The fan wheel is of generally cylindrical configuration having blades facing forward or backward relative to the direction of rotation thereof about the axis of the cylinder. The casing typically is spiral in shape to collect the air delivered from the fan wheel and to conduct the same in a spiral flow pattern to the outlet.

A typical centrifugal blower includes a cylindrical fan wheel having a radial center along its axis and a spiral shaped blower housing with a blower outlet at one end thereof. The air inlet to the blower is in a side wall to permit air flow into the center of the fan wheel.

The spiral blower housing has an approximate center of curvature, otherwise known as a radial center, which is the theoretical center of the spiral, but approximately falling in the vicinity of the radial center of the fan wheel. The blower housing has two wall portions which lead generally to the blower outlet. One of those wall portions is that part of the spiral shape of the blower housing that is relatively far or remote from the spiral center, and the other wall portion may be considered the involute wall portion. The latter is generally curved inwardly along the track of the spiral toward the center thereof. Typically, the fan wheel is positioned so that it is relatively near the involute wall surface but relatively far from the remote wall portion. With the fan wheel so positioned, there is a generally annular spirally expanding flow path along which air may be blown by the rotating fan toward the blower outlet for discharge from the fan wheel in a generally linear flow direction or flow path. Linear is used herein to indicate a non-spirally confined flow path, and may be a divergent one as the air blown through the blower outlet may diverge or expand upon so leaving.

In the past, furnace parts were made of galvanized metal and the housings for furnace fans and other centrifugal blowers were also made from galvanized metal. In more recent technology, the housing for centrifugal fans is molded of a plastic material. This permits the integral formation of the housing with the outlet.

A "cutoff" occurs at the end of the involute wall portion relatively proximate to the blower outlet. A cutoff is formed at the transition point where the spiral air flow occurring in the housing is transformed to the relatively straight line discharge air flow through the blower outlet. During such transition, the typical cutoff tends to cut off or to impede air flow through the clearance area between the cutoff and the fan wheel, which in the instance of the present invention, rotates in a clock-wise direction.

Generally, the blower outlet is a cylindrical tube connected to the housing into which the air is blown from the housing through an opening into the cylindrical outlet. Integrally molded housings with outlets permit formation of openings which can optimize the path of the spiral air flow during its transition to the straight line air flow. The cutoff region contributes significantly to audible noise, notably, an audible tone or whistle-like sound. In spite of efficiently designed openings from the housing into the outlet, the noise level at the cutoff continues to exist.

Certain attempts have been made to deal with the audible noise at the cutoff. For instance, in U.S. Pat. No. 5,040,943, the passageway from the housing to the outlet is designed such that the opening is absent any vertical edge in juxtaposition to the fan, the edge having a geometry of uniformly changing dimensions. Whereas, such a design may have diminished some of the audible noise, there is still existing a considerable audible noise at the point where the blade of the fan passes the cutoff.

The present invention provides an improved configuration of the opening for the passage of air from the housing into the outlet in a centrifugal blower.

SUMMARY OF THE INVENTION

The present invention provides an integrated centrifugal blower housing, and an air flow outlet, whereby the intersection of the housing and the outlet provides an opening, one edge of which contains at least one fin extending downwardly into the opening and positioned to generate at least one vortex in the flow of the air from the housing through the opening into the outlet. The opening from the housing into the outlet is defined, commencing at the base opposite the cutoff, by a vertical line extending from the base of the housing, upwardly terminating in a straight horizontal line, which line ends in a parabolic curve downwardly terminating at the base at the cutoff. The parabolic curve is interrupted by the fin. The fin is substantially triangular in shape and extends downwardly from the parabolic curve with a vertical edge facing the cutoff. The vertical height of the fin may vary depending upon the vortex strength required, but is generally from about 10% to about 60% of the height of the opening where the fin is situated. The fin is preferably situated on the parabolic curve at a point located from about 40% to about 70% of the length of the curve from the base at the cutoff end. While a specific location of the fin is shown and described in the drawings, those skilled in the art will understand that the location and number of fins may vary in other embodiments of the present invention.

The fin creates a marked change in the path of the air flow at the cutoff. The fin creates a vortex in the air flow, the vortex being located substantially behind the fin on the side of the housing, and causes the air flow at the cutoff to be markedly changed substantially eliminating the audible noise at the cutoff.

The most discernible noise by the human ear is caused by that of the blades of the radial fan passing the cutoff. The frequency generated by that noise is well within the discernible range of the human ear. Consequently, the most irritating noise caused by the centrifugal blower is the blade passing noise at the cutoff. The present invention provides a means of altering the air flow in such a manner as to substantially reduce the noise caused by the blade passing at the cutoff.

DETAILED DESCRIPTION OF THE INVENTION

Figure 1:
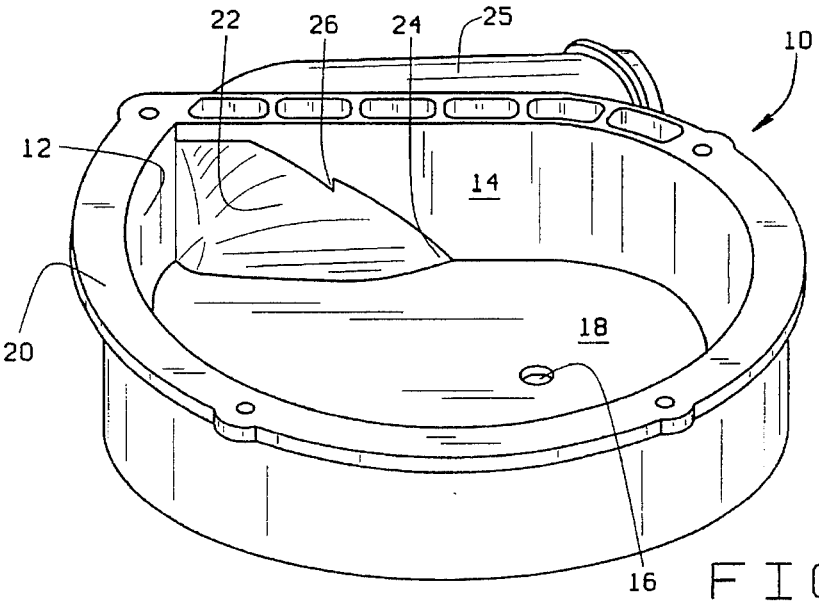
FIG. 1 is a perspective view of the housing of a centrifugal blower of one embodiment of the present invention.

With respect to FIG. 1, FIG. 1 depicts a portion of a centrifugal blower housing 10. The housing 10 is generally spiral in shape to collect the air delivered from the fan wheel, and to conduct the same in a spiral flow pattern to an outlet 25. The housing 10 has a base 18 and vertical walls 12 and 14. The wall 12 extends away from the fan wheel which is seated on an axis located at a hole 16. The wall 14 is an involute wall and extends inwardly toward the fan wheel (not shown). The air is moved in a clockwise direction and is delivered to the fan wheel through a side opening not shown in FIG. 1. The fan wheel will bring the air from the involute wall in a clockwise direction past the wall 12 and into an opening 22. The opening 22 is an opening in the housing 10 and opens into an outlet 25. The opening 22 which transports the air from the housing 10 to an outlet 25, has a shape which is designed to lower the noise of the fan in conjunction with air flow. Specifically, the opening 22 commencing at the base 18 at the wall 12, extends vertically and terminates in a horizontal line which terminates downwardly in a parabolic curve. The parabolic curve terminates at the base 18 on the wall 14 and creates a cutoff 24. The cutoff causes noise as the blades of the fan wheel pass the cutoff region. In order to redirect the flow of air to lessen the noise at the cutoff, a fin 26 is provided and situated approximately mid-way on the parabolic curve extending downwardly. The fin 26 has a vertical edge which allows a vortex to be created behind the fin 26 creating a negative pressure such that the air flow pattern is changed at the cutoff 24, and hence the noise is substantially reduced at the cutoff 24. The housing 10 is a section of the overall housing for a centrifugal blower. The housing 10 has a flange 20 with spaced holes to allow bolting of the portion of housing 10 to another mated portion to complete the centrifugal blower housing.

Figure 2:
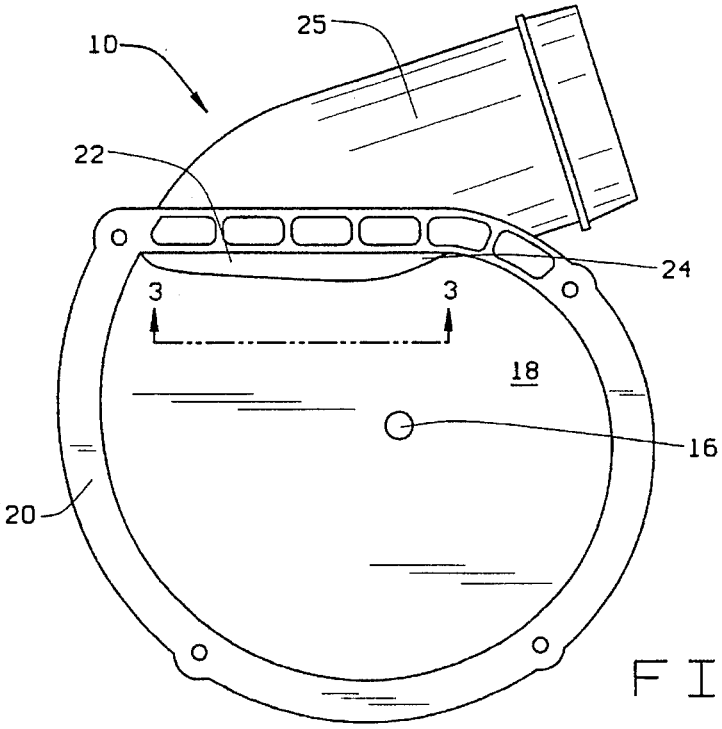
FIG. 2 is a top plan view of the centrifugal blower housing of FIG. 1.
Figure 3:
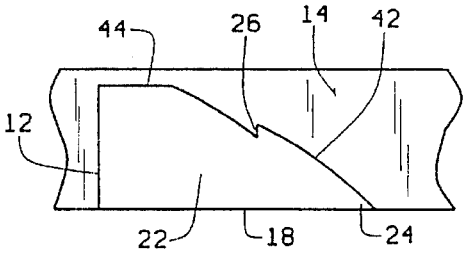
FIG. 3 is a partial sectional view along line 3—3 of the embodiment of FIG. 2 of the invention.

With respect to FIG. 2, a top plan view is depicted of a housing portion 10. The housing portion 10 has a base 18 and walls not visible in the top plan view which terminate in a flange 20, the flange having holes for mating the portion of housing to another part of the centrifugal blower housing. A hole 16 locates the axis of a fan wheel, not shown, which moves air within the housing. The opening 22 into the outlet 25 has a cutoff 24. In FIG. 3, the opening 22 of FIG. 2 is clearly depicted as viewed along line 3—3. In FIG. 3, the configuration of the opening 22 is defined by the base 18, a wall 12, and a portion of a wall 14. The wall 14 defines the opening with a straight line 44 coming from the wall 12, extending horizontally, ending in a parabolic curve 42, extending downwardly, and ending at the base 18. The parabolic curve 42 intersection with the base at 18 creates a cutoff 24. Approximately, midway on the parabolic curve is located a fin 26.

Figure 4:
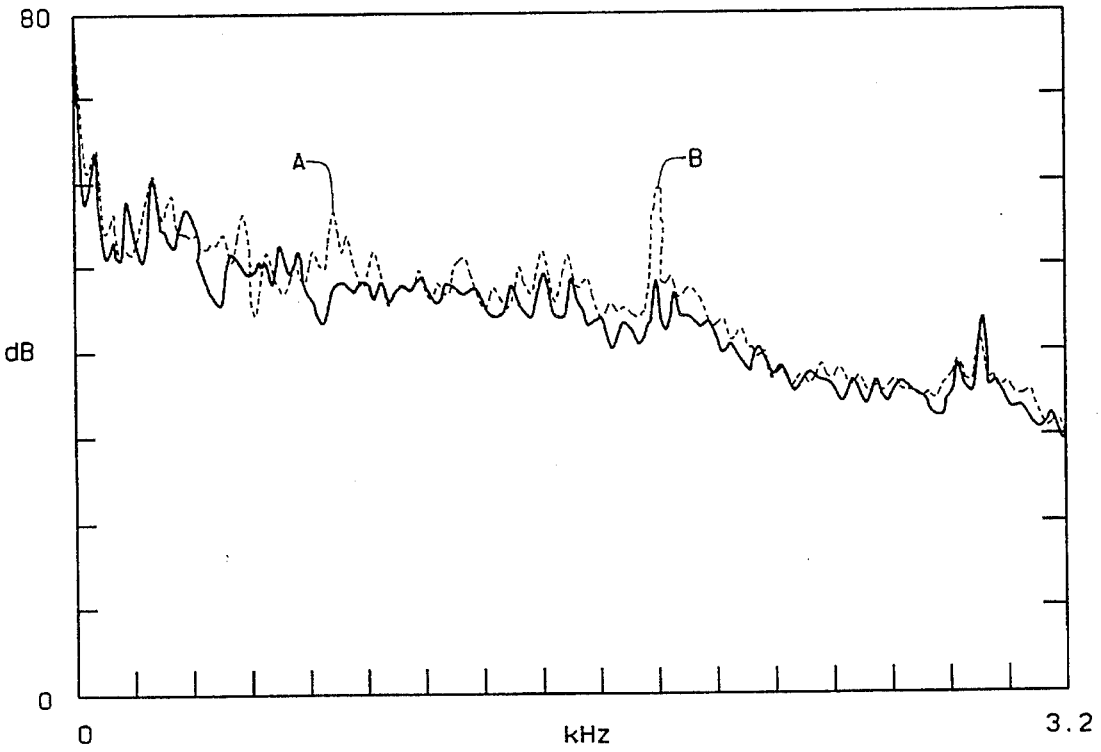
FIG. 4 is a graph depicting one embodiment of the present invention.

FIG. 4 is a graph depicting the prior art in dotted line and the present invention in the solid line. The graph indicates from the range of 0 to 3200 Hz, the noise level in decibels, which each blower provides. The peaks of noise from the prior art product at point A and point B are particularly disturbing to the human ear. It should be noted that the present product substantially eliminates these peaks of noise. The noise at the peak identified as B, is the blade-passing noise at the cutoff. The prior art centrifugal fan is one produced by Emerson Electric, St. Louis, Mo.

Figure 5:
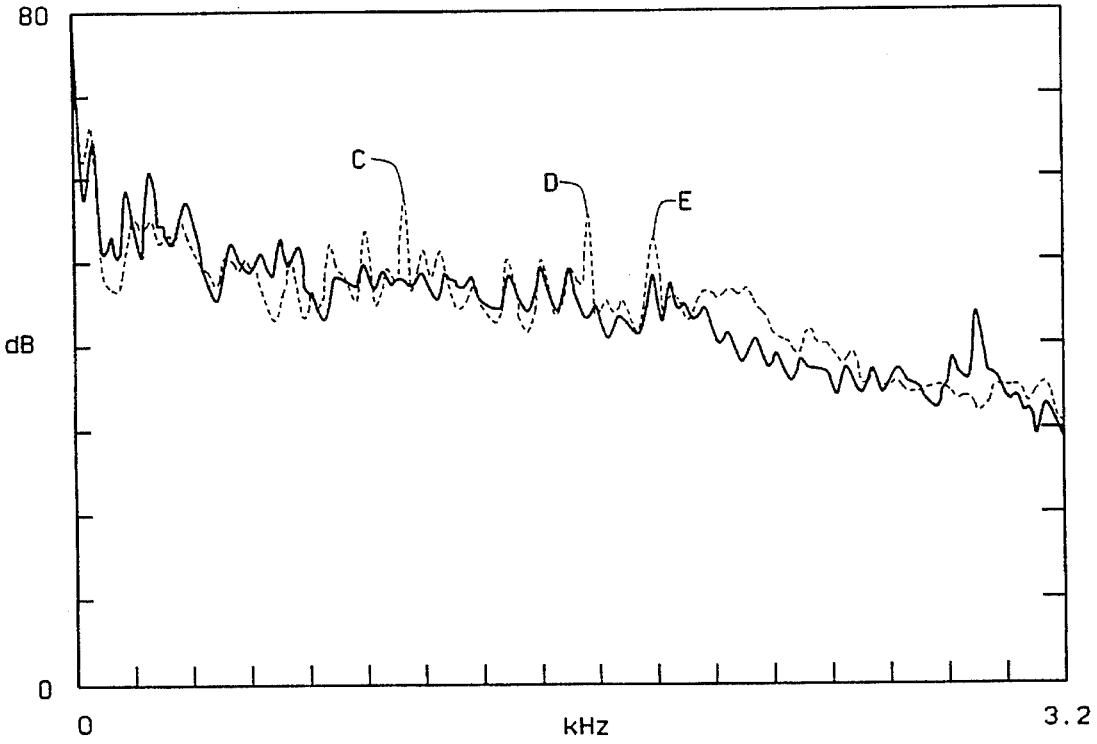
FIG. 5 is a graph depicting another embodiment of the present invention.

With respect to FIG. 5, the graph is very similar to FIG. 4; however, the dotted line represents the prior art which is a commercial unit manufactured by Ametec-Lamb Electric of Kent, Ohio, appearing to be in accordance with U.S. Pat. No. 5,040,943. Here again, it should be noted, that the blade passing noise is depicted by the point marked E on the graph, but it should be observed that the present invention denoted by the solid line substantially reduces the noise, for instance at points C and D, in much of the decibel range, which is particularly disturbing to the human ear.

For instance, as shown in Table 1 below, the blade passing amplitude in the prior art is shown in Sample Nos. 1 through 9. Sample Nos. 8 and 9 are subsequently modified according to the invention and the results are found in samples A through G. In each instance except Sample C, the fin was placed such that the tip of the fin was located at approximately 55% of the distance on the parabolic curve from the base of the parabolic curve. In the case of Sample C, a tip of the fin was located at about 65% of the distance from the base of the parabolic curve.

TABLE I

| Sample No. | Overall Noise dB (A) | Blade-Passing Amplitude dB | Fan Wheel RPM |
|---|---|---|---|
| 1 | 69 | 60 | 3289 |
| 2 | 66 | 54 | 3267 |
| 3 | 66 | 51 | 3317 |
| 4 | 66 | 55 | 3317 |
| 5 | 69 | 54 | 3280 |
| 6 | 66 | 55 | 3315 |
| 7 | 68 | 61 | 3290 |
| 8 | 67 | 58 | 3301 |
| 9 | 68 | 61 | 3301 |
| A | 65 | 47 | 3310 |
| B | 65 | 51 | 3317 |
| C | 66 | 53 | 3320 |
| D | 66 | 47 | 3327 |
| E | 66 | 47 | 3318 |
| F | 67 | 49 | 3323 |
| G | 66 | 48 | 3317 |

Although the Samples A through G show only a slight improvement in overall noise over the prior art Sample Nos. 1–9, the difference in blade passing amplitude is significant. Each of the modified samples had a fin described as the preferred embodiment of the present invention. The noise reduction over that of Sample Nos. 8 and 9 by A through G including Sample C was about 18%. This is a considerable reduction in noise. The average noise reduction over the average blade passing amplitude of the prior art is 14%. This still is a significant reduction in noise.

Most generally a single fin extending downwardly from the top of the opening is sufficient to create the desired vortex. However, if an even stronger vortex is desired, more fins can be added extending upwardly from the base immediately below the first fin. Preferably the extra fin(s) would also have a vertical side facing the cutoff.

We claim:

1. A centrifugal air blower comprising an integrated housing and an outlet conduit whereby the intersection of the housing and the outlet provides an opening which is defined by a vertical line extending from a base of the housing upwardly terminating in a straight horizontal line ending in a parabolic curve downwardly terminating at the base, the parabolic curve being interrupted by a fin extending downwardly into the opening and positioned to generate at least one vortex in a flow of air from the housing through the opening and into the outlet.

2. The blower of claim 1 wherein the fin has a vertical edge.

3. The blower of claim 2 wherein the vertical height of the fin is from about 10% to about 35% of the height of the opening where the fin is situated.

4. The blower of claim 3 wherein the vertical height of the fin is about 20% of the height of the opening wherein the fin is situated.

5. The blower of claim 1 wherein the fin is situated on the parabolic curve at a point located from about 40% to about 70% of the length of the curve from the base.

6. The blower of claim 5 wherein the fin is situated on the parabolic curve at a point located at about 55% of the length of the curve from the base.

7. A centrifugal air blower comprising an integrally connected exhaust outlet and a blower housing containing an opening communicating with the exhaust outlet, the opening being outlined by a vertical line from a base of the housing upward intersecting a straight horizontal line ending in a parabolic curve downwardly terminating at the base, the parabolic curve being interrupted by a fin extending downwardly positioned to form a vortex in the air passing from the housing to the exhaust outlet.

* * * * *